US005968402A

United States Patent [19]

Lee

[11] Patent Number: 5,968,402

[45] Date of Patent: Oct. 19, 1999

[54] SAFETY SYSTEM FOR MICROWAVE OVEN WITH ELECTRIC HEATER

[75] Inventor: Gi-Hun Lee, Kyungki-Do, Rep. of Korea

[73] Assignee: Samsung Electronics Co., Ltd., Suwon, Rep. of Korea

[21] Appl. No.: 08/989,003

[22] Filed: Dec. 11, 1997

[30] Foreign Application Priority Data

Jan. 11, 1997 [KR] Rep. of Korea ..... 97-602

[51] Int. Cl.[6] ..... H05B 6/68

[52] U.S. Cl. ..... 219/720

[58] Field of Search ..... 219/702–713, 219/723, 720, 685, 506, 413, 453; 126/273 R, 275 G

[56] References Cited

U.S. PATENT DOCUMENTS 4,134,005 1/1979 Eppens et al. ..... 219/413

4,463,238 7/1984 Tanabe et al. ..... 219/720

5,528,018 6/1996 Burkett et al. ..... 219/506

FOREIGN PATENT DOCUMENTS 08261479 11/1996 Japan .

*Primary Examiner*—Teresa Walberg

*Assistant Examiner*—Jeffrey Pwu

*Attorney, Agent, or Firm*—Burns, Doane, Swecker & Mathis, L.L.P.

[57] ABSTRACT

A microwave oven includes an electric heater disposed in the cooking chamber for cooking by radiant heat. A temperature sensor senses a temperature of the heater, and a door sensor senses an open state of the oven door. If the oven door is open, and the heater temperature is at or above a reference temperature (i.e., a temperature which could burn a user), an alarm, such as an audio and/or visual alarm, is activated to warn the user.

5 Claims, 5 Drawing Sheets

SAFETY SYSTEM FOR MICROWAVE OVEN WITH ELECTRIC HEATER

BACKGROUND OF THE INVENTION

1) Field of the Invention

The present invention generally relates to a microwave oven having an electric heater for cooking by radiant heat.

2) Description of the Prior Art

A microwave oven is a cooking appliance which cooks food with high speed frequency energy of 2,450 MHz. This energizes food molecules to move at high speeds to produce frictional heat. Such a microwave oven also has a heater in its cooking chamber to provide a grilling function for cooking food using direct heat.

FIG. 1 is a front view of a conventional microwave oven. As shown in FIG. 1, the conventional microwave oven includes a cooking chamber 10 in which food is cooked by high frequency energy; a door 20 for opening and closing the cooking chamber 10; a rotary motor (not illustrated); a rotary stand 11 connected with the rotary motor; and a tray 12 adapted to be positioned on the rotary stand 11, and on which the food is placed.

The conventional microwave oven also includes a heater 13 for performing the grill function; a thermistor 14 which senses the temperature of the cooking chamber 10; a control panel having a display 30 showing the operation information of the microwave oven and a function selection part 40; a magnetron antenna (not illustrated) mounted on the sidewall of the cooking chamber's upper portion for emitting high frequency energy to the cooking chamber 10; and a magnetron (not illustrated) installed in a space at the rear of the display 30 for applying the high frequency energy to the magnetron antenna.

The heater 13 is positioned on the rear upper portion of the cooking chamber 10 and is able to be rotated by a predetermined angle. The heater 13 is held in place by a supporting member each provided on a side wall of the cooking chamber 10. Thus, when a user cooks with the heater 13, a lamp of the cooking chamber 10 (not illustrated) is switched on to illuminate the cooking chamber 10, and the tray 11 then rotates. Heat is produced when electricity is applied to the heater 13. When the programmed cooking time is complete, the electricity applied to the heater 13 is shut off, and the heater 13 stops producing heat. When the cooking operation is complete, the microwave signals the user.

The heater 13 remains hot for a predetermined period of time even after the cooking time has finished, since its temperature diminishes slowly. Since the conventional microwave oven cannot measure the temperature of the heater 13, the user may not know that the temperature of the heater 13 is higher than the microwave oven's internal temperature. Thus, when the user tries to cook food with the conventional microwave oven before the heater 13 cools, he may touch the hot heater 13 as he either puts the food being cooked in the cooking chamber 10 or takes it out of the cooking chamber 10. If his or her hand touches the heater 13, he or she may get burnt, and instantaneously drop the food that he or she is holding.

SUMMARY OF THE INVENTION

The present invention involves a safety system for a microwave oven that can obviate disadvantages of the conventional technique.

It is an objective of the present invention to provide a safety system for a microwave oven with a heater which warns a user if the surface temperature of the oven's heater is over a predetermined point to prevent the chance of a burn injury to the user.

In order to obtain the above-mentioned objective of the present invention, there is provided a microwave oven which comprises a main body forming a cooking chamber having a door. A microwave generator supplies microwaves to the cooking chamber. An electric heater is located at an upper portion of the cooking chamber for cooking by direct heat. A first temperature sensor is provided for sensing an overall internal temperature of the cooking chamber. A second temperature sensor is disposed adjacent to the heater for sensing a temperature of the heater. A door sensor is provided for sensing an open state of the door. An alarm is operably connected to the second temperature sensor and the door sensor for emitting a warning signal in response to the sensed temperature being at or above a reference temperature, and the door being open.

Preferably, the alarm emits an audio signal.

The second temperature sensor preferably comprises a bimetallic switch including a laminate of metals having different thermal expansion coefficients. The bimetallic switch closing in response to the heater temperature being at or above the reference temperature. Preferably the door sensor is a switch which closes when the door is open, and which is connected in series with the alarm and the bimetallic switch.

The second temperature sensor may comprise a thermistor having a resistance varying according to changes in temperature. The thermistor is disposed in a circuit to which a voltage is applied, for converting the voltage in accordance with the thermistor resistance. A control unit is connected to the circuit for detecting the converted voltage and comparing the converted voltage with a reference voltage. The control unit also is connected to both the door sensor and the alarm to activate the alarm in response to: (a) the door being open and (b) the comparison between the converted voltage and reference voltage indicating that the heater temperature being at or above the reference temperature.

BRIEF DESCRIPTION OF THE DRAWINGS

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
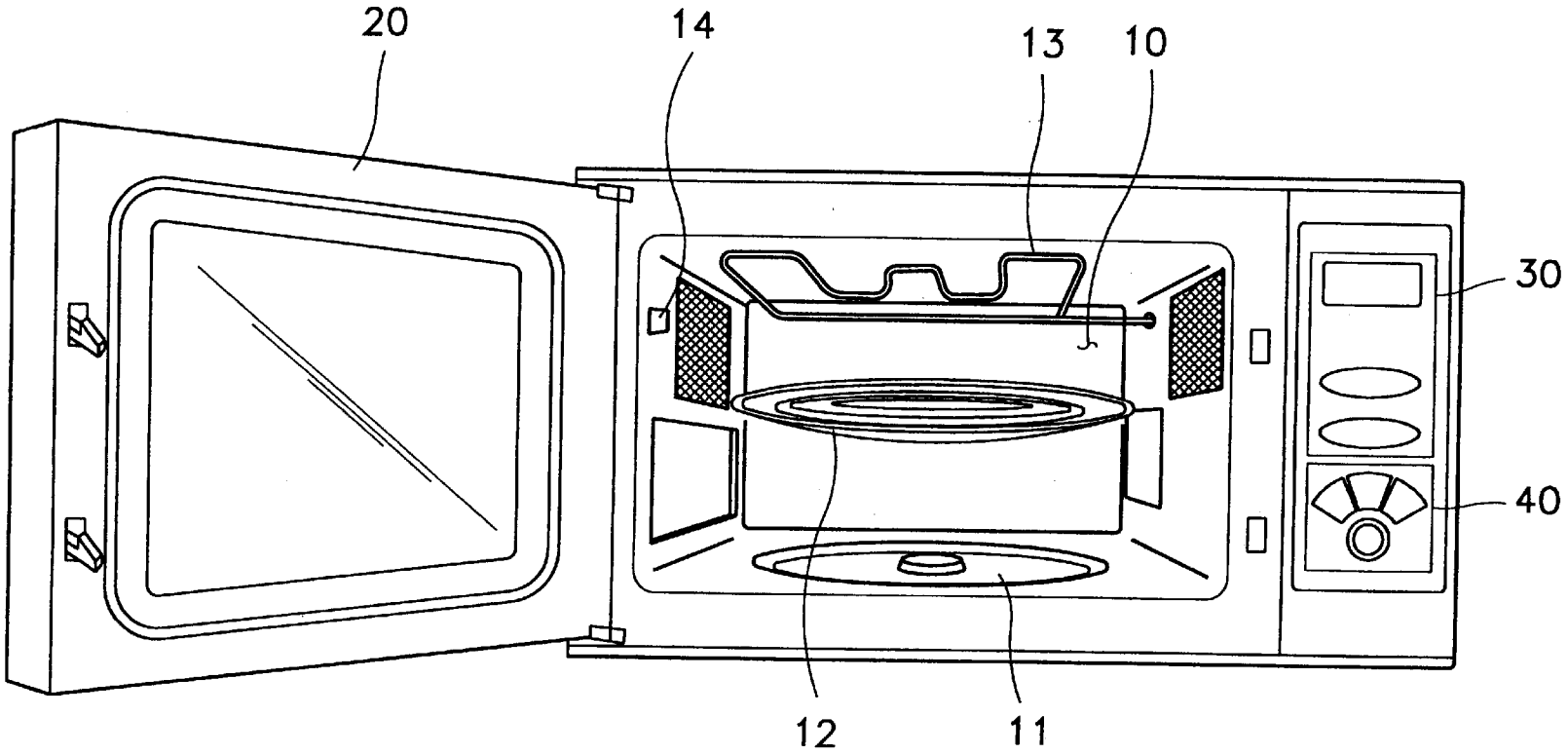
FIG. 1 (PRIOR ART)
FIG. 1 is a front view of a microwave oven in accordance with a conventional art.

Preferred embodiments of the present invention will be described in detail with reference to FIGS. 2–5. The same items as in FIG. 1 are given the same reference numerals and their description will not be repeated.

Figure 2:
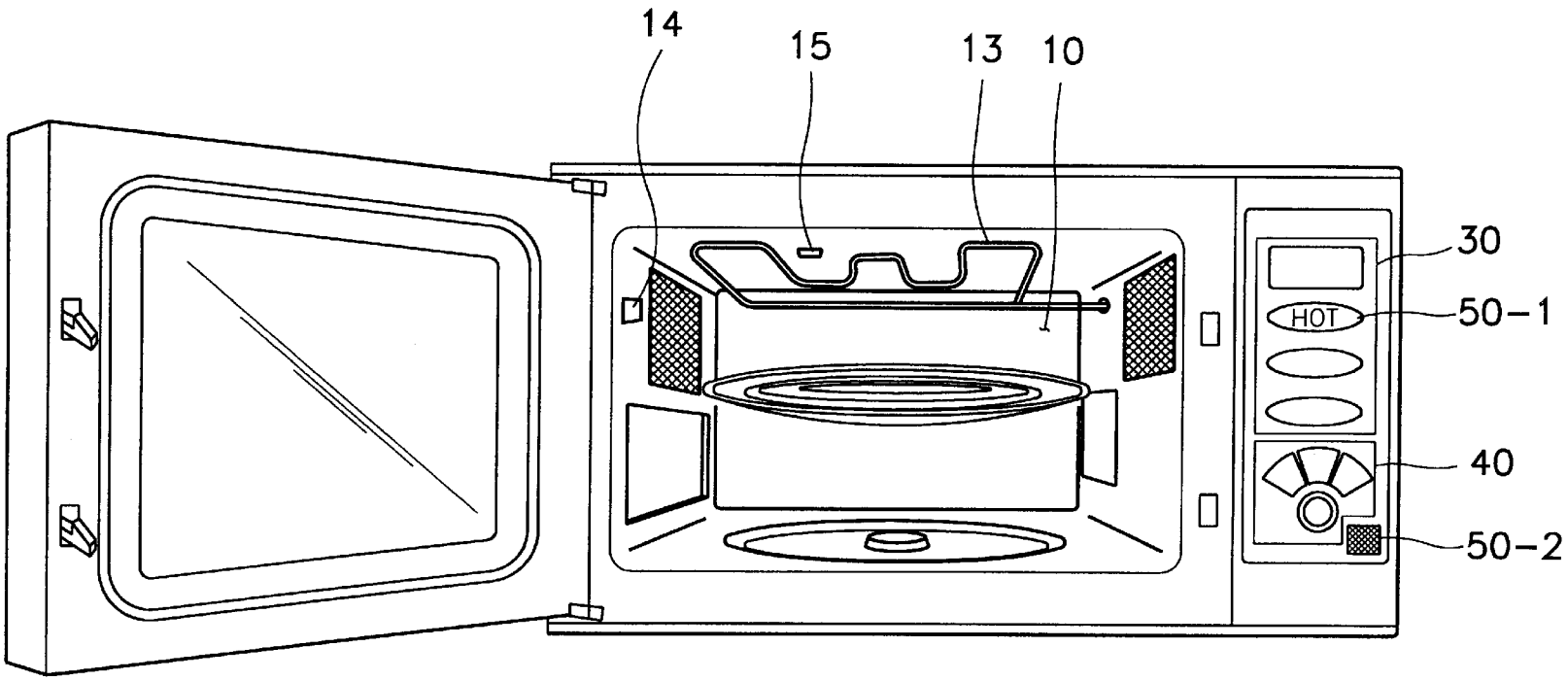
FIG. 2 is a front view of a microwave oven in accordance with the present invention.
Figure 3:
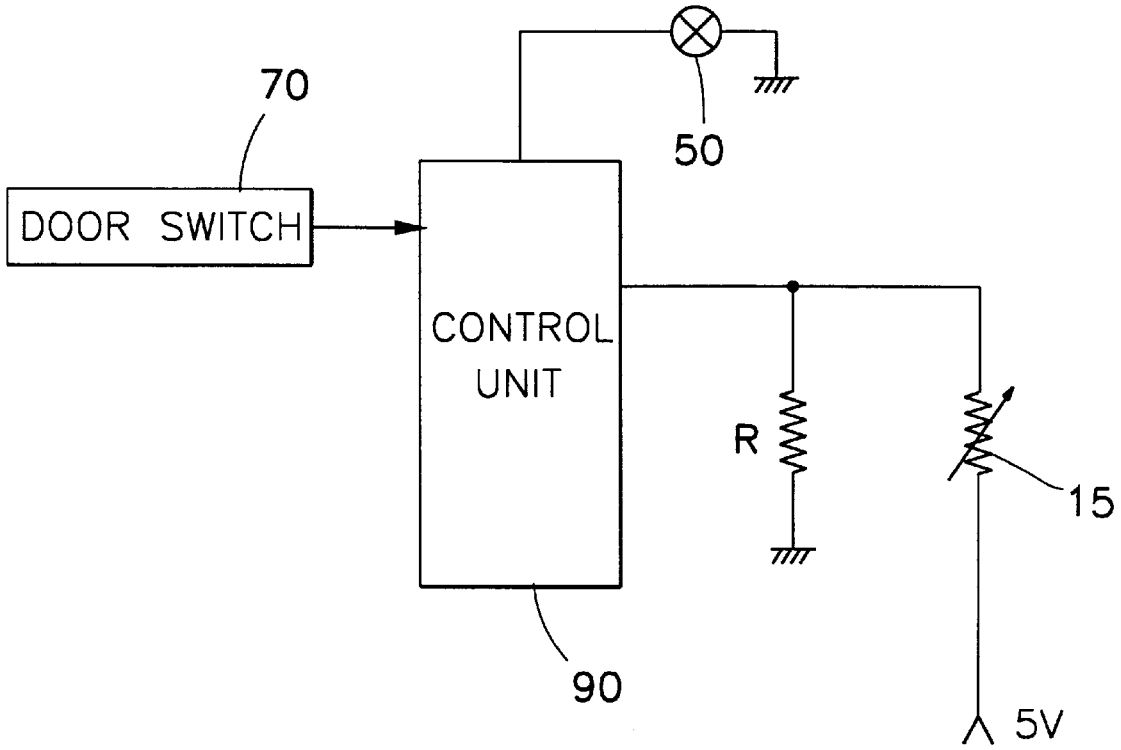
FIG. 3 is a circuit diagram of a driver circuit for a safety system of the microwave oven in accordance with a first preferred embodiment of the present invention.
Figure 4:
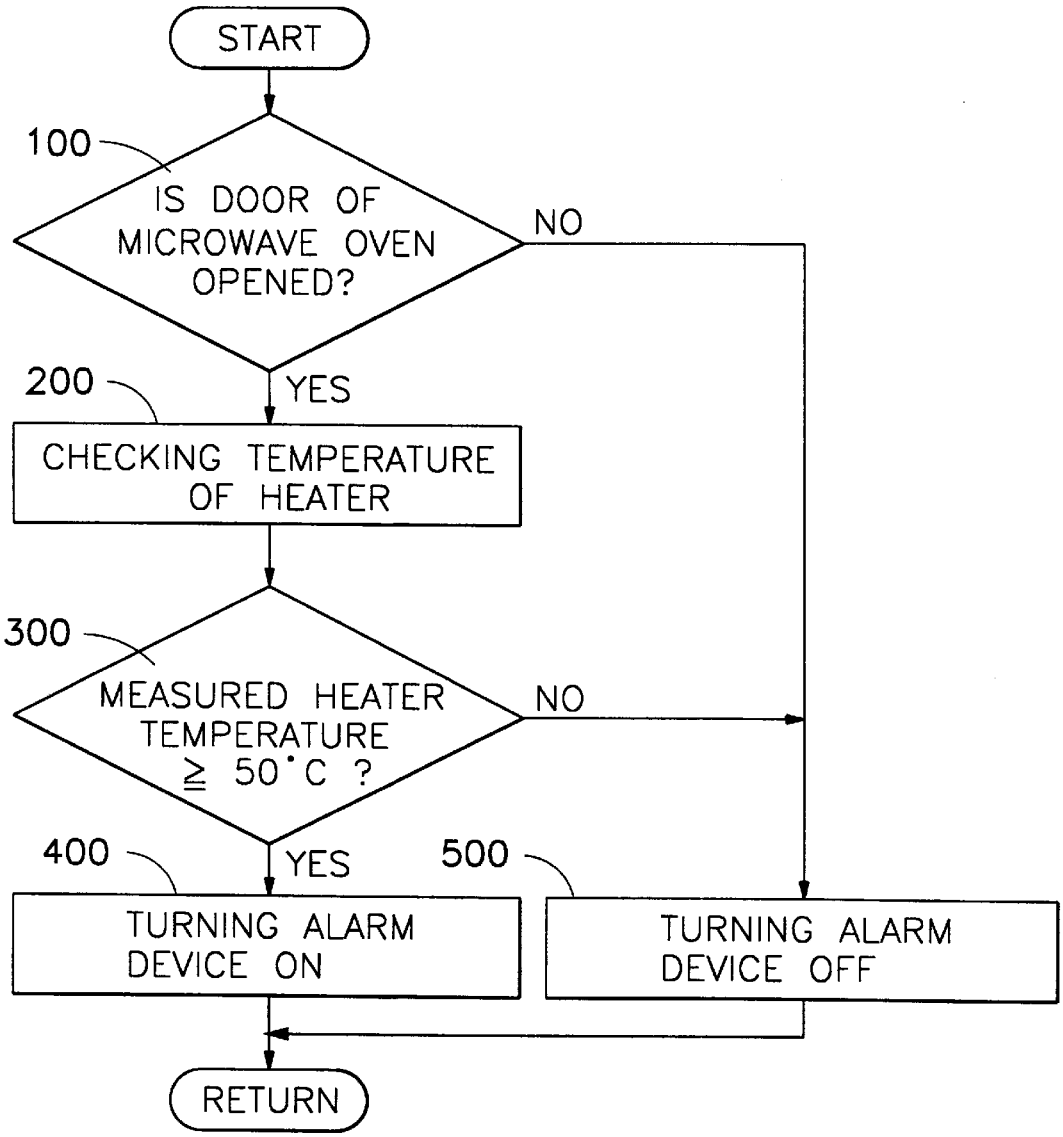
FIG. 4 depicts the control sequence of the driver circuit of FIG. 3.

FIG. 2 is a front view of a microwave oven having a heater temperature sensor for measuring a surface temperature of a heater in accordance with the present invention. FIG. 3 is a circuit diagram of a driver circuit for a safety system of the microwave oven in accordance with a first preferred embodiment of the present invention. FIG. 4 depicts the control sequence of the driver circuit of FIG. 3.

Referring first to FIG. 2, a microwave oven of the present invention includes a heater temperature sensor 15 for checking the temperature of a heater 13, and this heater temperature sensor 15 is disposed at a predetermined point of the cooking chamber's ceiling, so as to be close to the heater 13.

A function selection part 40 and display 30 are provided in the front panel of the microwave oven to allow a user to manipulate and confirm with ease, and the function selection part 40 has a cooking selection switch, a grill mode selection switch, and a power switch.

The display 30 shows a user information programmed through the function selection part 40, and includes a visual alarm 50-1 which gives a user a warning if the temperature of the heater 13 is high when he or she opens a door 20 of the microwave oven. An audio alarm such as a buzzer is provided to the outside of the display 30.

FIG. 3 is a circuit diagram of the inventive safety system, including the heater temperature sensor 15 for sensing the temperature of the heater 13, and visual and audio alarms 50-1 and 50-2.

As shown in FIG. 3, the inventive safety system includes a control unit 90 to which the heater temperature sensor 15 is coupled in series with a resistor R therebetween, and an alarm device 50 that is operated by an output signal of the control unit 90. The control unit 90 controls the alarm device 50 according to a value of voltage converted by the heater temperature sensor 15 after sensing the temperature of the heater 13. That is, the resistor 15 is selected so that when a temperature greater than a reference temperature is sensed, the alarm sounds. The reference temperature is selected to be a value which will cause a user to be burned upon touching the heater. Thus, for example a reference temperature of 50° C. can be selected.

As shown in FIG. 3, the alarm device 50 consists of the visual alarm 50-1 and the audio alarm 50-2.

The heater temperature sensor 15 is preferably a thermistor, i.e., a temperature-sensitive resistor whose resistance increases as the temperature increases.

Thus, the value of resistor R and the material of the thermistor 15 are chosen so that if the temperature of the heater 13 is higher than the reference temperature, 50° C., the control unit 90 sounds the alarm device 50. If the temperature of the heater 13 drops to 50° C. or less, the control unit 90 deactivates the alarm device 50.

For example, with the heater temperature above 50° C., if a constant voltage of 5 V is applied across the thermistor 15, the control unit 90 will detect a value of 2.5 V or less. Accordingly, a voltage of 2.5 V is used as a reference voltage. If it is determined that the sensed voltage is lower than the reference voltage, it is determined that the temperature of the heater 13 is higher than the reference temperature, 50° C., and a driving signal is sent to the alarm device 50.

If the temperature of the heater 13 decreases below the reference temperature, the temperature sensed by the thermistor 15 also drops. Thus, the resistance of the thermistor 15 decreases, and if the control unit 90 detects a voltage higher than the reference voltage (2.5 V), it interprets that the temperature of the heater 13 is lower than the reference temperature, 50° C., and does not operate the alarm device 50.

The following description concerns the mutual operation of the above components of the microwave oven.

Referring to FIG. 4, depicting the control sequence of the driver circuit of FIG. 3, if a user selects to cook using the heater 13, the control unit 90 controls the power applied across the heater 13 so that the heater 13 produces heat. The display 30 then shows the user the programmed information on the function selection part 40. When the programmed cooking time is over, the power applied to the heater 13 is shut off so that the heater 13 does not emit the heat, informing the user of completion of the cooking. Cooked food is then removed from the cooking chamber 10. In addition, even if the programmed cooking time is not over yet, the user may open the door 20 in order to inspect the cooking process or to bring the food out of the cooking chamber 10.

If the door 20 is opened, the control unit 90 senses it (Step 100). Once the control unit 90 senses (Step 100) that the door 20 is being opened, it detects (Step 200) the temperature of the heater 13 at predetermined intervals using the thermistor 15. If the control unit 90 does not sense the door 20 being opened, it returns to the initial stage. The control unit 90 then determines (Step 300) if the temperature of the heater 13 that it measured at Step 200 is higher than the preset reference temperature (50° C.). As described above, referring to FIG. 3, the control unit 90 checks whether a voltage of 2.5 V or less is detected when the voltage of 5 V is applied to the thermistor 15.

If the control unit 90 determines (Step 300) that the temperature of the heater 13 is higher than the preset reference temperature (50° C.), i.e., if it detects a voltage of 2.5 V or less, the alarm device 50 is activated (Step 400). More specifically, the lamp of the display 30 (i.e., the visual alarm device 50-1) is switched on, and the audio alarm device 50-1, buzzer, is turned on. Thus before a user puts his or her hand in the cooking chamber 10 in order to either take the food out of the cooking chamber 10 or bring it in the cooking chamber 10, the alarm device 50 lets the user know that the heater 13 is still hot, thus preventing him or her from getting a burn. On the contrary, if the control unit 90 determines that the temperature of the heater 13 is lower than the preset reference temperature (50° C.) at Step 300, i.e., if it detects a voltage over 2.5 V, the alarm device 50 is turned off (Step 500). Operation then returns to the initial stage.

If the control unit 90 determines that the temperature of the heater 13 is higher than the preset reference temperature (50° C.) at Step 300, and then returns to the initial stage with the alarm device turned on at Step 400, it continuously checks (Step 200) the temperature of the heater 13 at predetermined time intervals. The control unit 90 also compares (Step 300) the detected temperature with the preset reference temperature. if the control unit 90 determines that the detected temperature is lower than the preset reference temperature, it controls the power applied to the alarm device 50, thus stopping its operation (Step 500). In case that the control unit 90 determines that the detected temperature is higher than or equal to the preset reference temperature, it keeps operating the alarm device 50 (Step 400). As the control unit 90 senses that the door 20 is closed by the user, it deactivates the alarm device 50.

Figure 5:
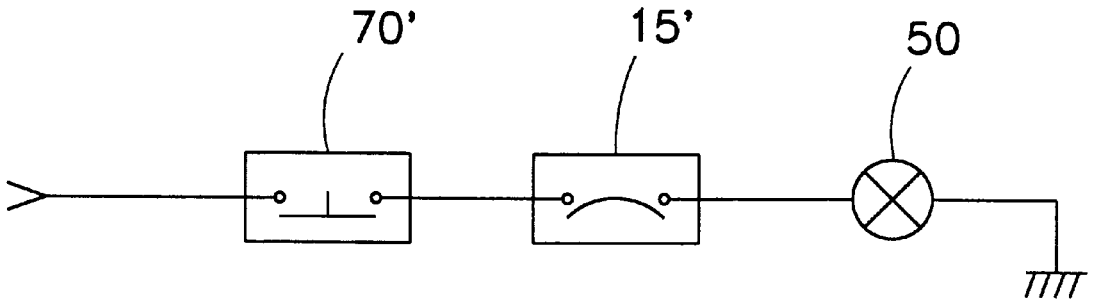
FIG. 5 is a circuit diagram of the microwave oven in accordance with a second preferred embodiment of the present invention.

Another preferred embodiment of the present invention is now described referring to FIG. 5.

A driver circuit for the safety system includes a bimetal sensor 15' serving to open and close its contact at a given point of temperature, a door switch 70 sensing the opening and closing of the door 20, and an alarm device 50. The sensor 15' is made of two laminated metals having different coefficients of thermal expansion.

Once the temperature of the heater 13 within the cooking chamber 10 increases to a predetermined point and over, the bimetal sensor 15', closes its contact to turn on the driver circuit for the safety system. If the temperature of the heater 13 goes below the predetermined point, the bimetal sensor 15' opens its contact to turn off the driver circuit. The door switch 70 is operated by a push button, and opening and closing the door 20 turns the driver circuit on and off.

Thus, when the temperature of the heater 13 increases to a predetermined point and the door 20 is opened, the driver circuit is automatically closed to drive the alarm device 50. If the user closes the door 20 when the temperature of the heater 13 is higher than the predetermined point, the switch 70' opens to deactivate the alarm device 50.

In accordance with the present invention, as described above, the extra heater temperature sensor is provided for a microwave oven for measuring the temperature of the heater only. When the door of the microwave oven is opened, and the measured heater temperature is high enough to burn the user, the alarm device sounds a warning. In such a manner, the present invention prevents the user from being burnt by the hot heater.

Although the present invention has been described in connection with preferred embodiments thereof, it will be appreciated by those skilled in the art that additions, modifications, substitutions and deletions not specifically described may be made without departing from the spirit and scope and invention as defined in the appended claims.

What is claimed is:

1. A microwave oven comprising:

a main body forming a cooking chamber having a door;

a microwave generator for supplying microwaves to the cooking chamber;

an electric heater located at an upper portion of the cooking chamber for cooking by direct heat;

a first temperature sensor for sensing an overall internal temperature of the cooking chamber;

a second temperature sensor disposed adjacent the heater for sensing a temperature of the heater;

a door sensor for sensing an open state of the door; and an alarm for emitting a warning signal warning that the heater is hot, said alarm operably connected to the second temperature sensor and the door sensor for emitting the warning signal only in response to the simultaneous occurrence of: the second temperature of the heater being at or above a reference temperature, and the door being open.

2. The microwave oven according to claim 1 wherein the alarm emits an audio signal.

3. The microwave oven according to claim 1 wherein the second temperature sensor comprises a bimetallic switch including a laminate of metals having different thermal expansion coefficients, the bimetallic switch closing in response to the heater temperature being at or above the reference temperature.

4. The microwave oven according to claim 3 wherein the door sensor is a switch which closes when the door is open, the door sensor switch and bimetallic switch being connected in series with the alarm.

5. The microwave oven according to claim 1 wherein the second temperature sensor comprises a thermistor having a resistance varying according to changes in temperature; the thermistor disposed in a circuit to which a voltage is applied, for converting the voltage in accordance with the thermistor resistance; a control unit connected to the circuit for detecting the converted voltage and comparing the converted voltage with a reference voltage; the control unit also connected to the door sensor and the alarm to activate the alarm in response to the door being open and the comparison between the converted voltage and reference voltage indicating that the heater temperature is at or above the reference temperature.

* * * * *